United States Patent [19]

Erickson

[11] Patent Number: 4,603,751

[45] Date of Patent: Aug. 5, 1986

[54] MECHANICALLY FASTENED CENTER VACUUM ROOF DRILL BIT

[75] Inventor: Robert A. Erickson, Latrobe, Pa.

[73] Assignee: Kennametal Inc., Latrobe, Pa.

[21] Appl. No.: 580,825

[22] Filed: Feb. 16, 1984

[51] Int. Cl.[4] ..... E21B 10/46

[52] U.S. Cl. ..... 175/410; 299/93

[58] Field of Search ..... 175/410, 417, 418; 299/93

[56] References Cited

U.S. PATENT DOCUMENTS

| | | | |
|---|---|---|---|
| 2,575,239 | 11/1951 | Stephens | 175/418 |
| 3,140,749 | 7/1964 | Dionisotti | 175/418 |
| 3,434,554 | 3/1969 | Bower, Jr. | 175/418 |
| 4,313,506 | 2/1982 | O'Connell | 175/418 |
| 4,433,739 | 2/1984 | Sarin | 175/418 |

*Primary Examiner*—Stephen J. Novosad
*Assistant Examiner*—William P. Neuder
*Attorney, Agent, or Firm*—Lawrence R. Burns

[57] ABSTRACT

Disclosed according to the invention is a center vacuum roof drill bit. The roof drill bit has a body having an axis of rotation, a seat transverse to the axis of rotation, a periphery and a forward working end. The roof drill bit has at least one flat-like insert positioned on the seat. There is also means for releasably clamping the insert, the means clamping the insert near the periphery only of the body. In other embodiments of the roof drill bit, there is a second flat-like insert and, additionally, provisions are made for self centering the insert or inserts.

14 Claims, 22 Drawing Figures

Fig. 1
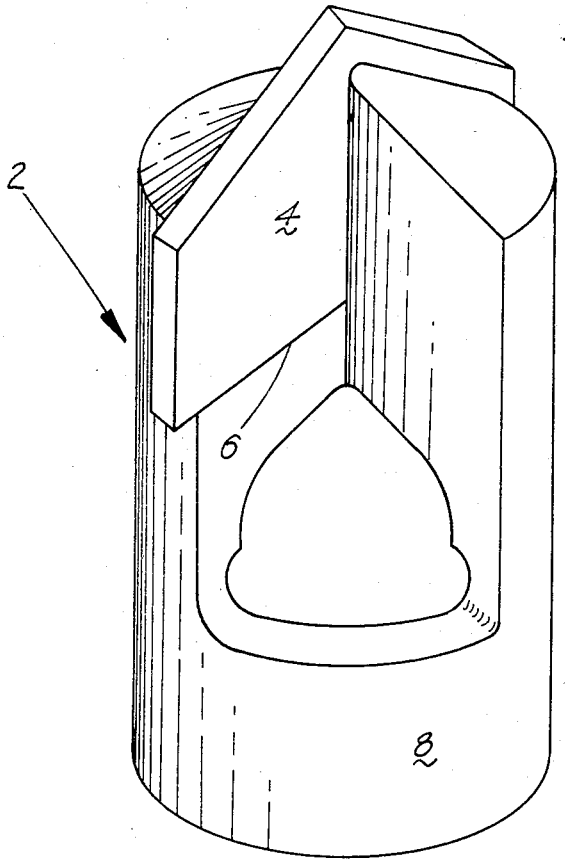
Fig. 2
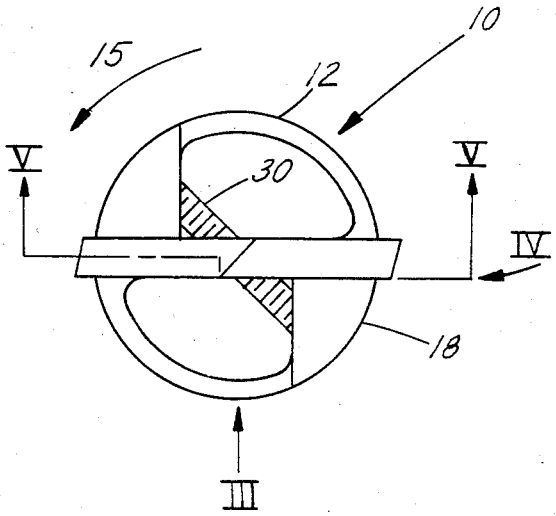
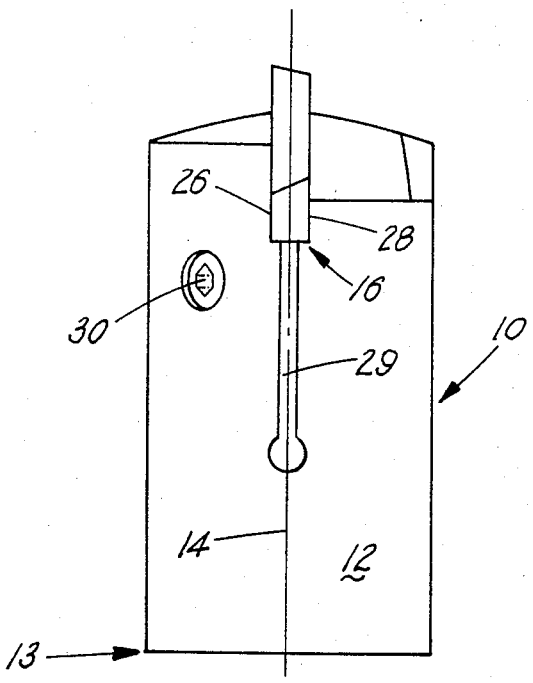
Fig. 4
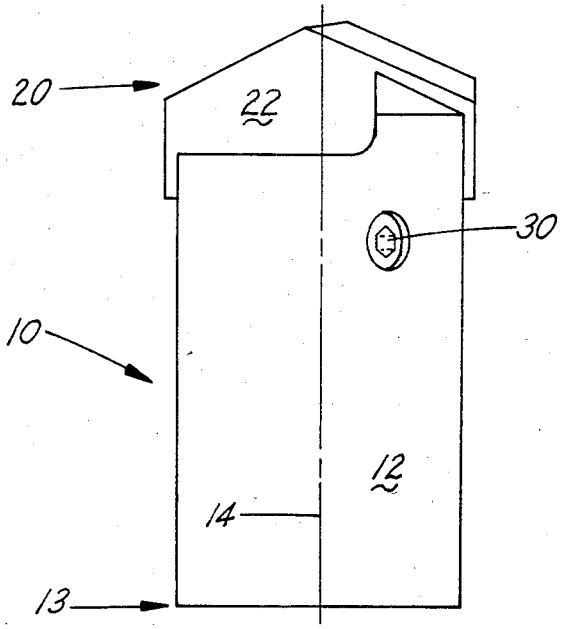
Fig. 3

MECHANICALLY FASTENED CENTER VACUUM ROOF DRILL BIT

BACKGROUND OF THE INVENTION

The present invention relates to the field of drill bits for drilling in rock and other earthen formations. More particularly, the present invention relates to center vacuum drill bits as are most useful in drilling blast holes and ceiling anchor holes in coal mines.

The well known prior art center vacuum drill bit is shown in FIG. 1. The center vacuum drill bit 2 comprises a generally flat insert of hard wear resistant material 4, usually cemented carbide, situated in a body 8. The insert is typically brazed 6 to the body.

While this prior art drill bit has performed well, it would be desirable to improve the construction of the drill bit. One improvement would be to make the insert readily releasable from the body. This improvement is of importance for three reasons. The first is that the worn insert can be easily removed for salvage. The second is that the body can be reused when a new insert is situated in the body. The third, and possibly most important, reason is that all brazing problems, as are well known to those skilled in the art, can be effectively eliminated.

Releasable inserts in rock drills are illustrated in U.S. Pat. Nos. 2,575,239 and 3,878,905. However, since these rock drills require that the insert be held in the center, the inserts must necessarily be unsuitable for use in center vacuum drill bits.

Another type of releasable insert is manufactured by Alaskaug Inc., Cincinnati, Ohio. This releasable insert is used in a blast hole auger bit. Again, the type of arrangement manufactured would not be suitable for use as a center vacuum drill bit.

Accordingly, it is an object of the invention to have a releasable insert suitable for use with a center vacuum drill bit.

It is another object of the invention to have a center vacuum drill bit that is easily and economically manufactured.

BRIEF SUMMARY OF THE INVENTION

Disclosed according to the invention is a center vacuum roof drill bit. The roof drill bit has a body having an axis of rotation, a seat transverse to the axis of rotation, a periphery and a forward working end. The roof drill bit has at least one flat-like insert positioned on the seat. There is also means for releasably clamping the insert, the means clamping the insert near the periphery only of the body. In other embodiments of the roof drill bit, there is a second flat-like insert and, additionally, provisions are made for self centering the insert or inserts.

Since the insert, or in the embodiments where there is a second insert, is releasably clamped in the body, the insert can be easily removed for salvage. In those situations where the body is in satisfactory condition, a new insert can be situated into the body and the combination of the body and insert can then be used. It is also evident that, since the insert is mechanically held by the body, there is no need for any brazing of the insert to the body. It follows that all problems associated with brazing which are known to those skilled in the art can be effectively eliminated.

BRIEF DESCRIPTION OF THE DRAWINGS

The exact nature of the present invention will become more clearly apparent upon reference to the following detailed specification, taken in connection with the accompanying drawings, in which:

FIG. 1 is a perspective view of a prior art drill bit.

FIG. 2 is a plan view of the drill bit according to the invention.

FIG. 3 is a view of FIG. 2 in the direction of arrow III.

FIG. 4 is a view of FIG. 2 looking in the direction of arrow IV.

DETAILED DESCRIPTION OF THE INVENTION

Figure 5:
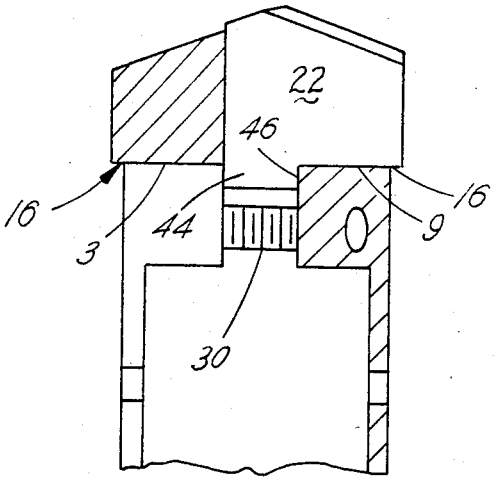
FIG. 5 is a sectional view of FIG. 2 in the direction of arrows V—V.

Referring to the drawings somewhat more in detail, and particularly referring to FIGS. 2 through 5, disclosed according to the invention is a center vacuum roof drill bit 10 comprising a body 12 and at least one flat-like insert 22. The body has an axis of rotation 14, a seat 16 transverse to the axis of rotation, a periphery 18 and a forward working end 20. The at least one flat-like insert 22 is positioned on the seat 16. The drill bit also comprises means for releasably clamping the insert, the means clamping the insert near the periphery 18 only of the body 12.

In practice, as known to those skilled in the art, the roof drill bit 10 would be releasably connected to a roof drill (not shown) by a suitable connector of the roof drill engaging the roof drill bit body 12 at the axially rearward end 13. Once connected, the roof drill bit would rotate about its axis of rotation 14. The proper direction of rotation is indicated by arrow 15.

Figure 6:
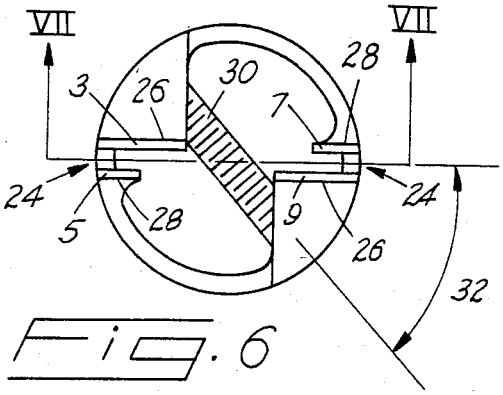
FIG. 6 is a plan view of the drill bit of FIG. 2 with the insert removed.
Figure 7:
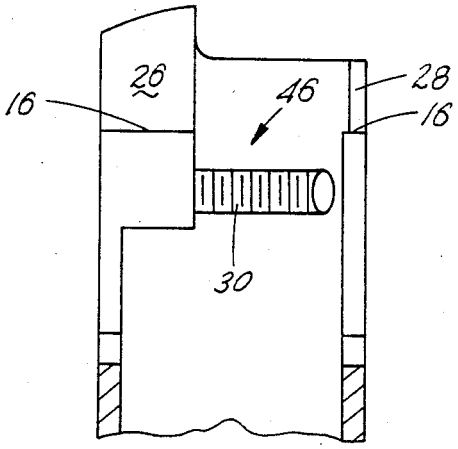
FIG. 7 is a sectional view of FIG. 6 in the direction of arrows VII—VII.

Referring additionally to FIGS. 6 and 7, the clamping means comprises two pairs 24 of oppositely facing walls 26, 28 extending axially forward from the seat 16 and intersecting the periphery 18. Each pair of walls is diametrically opposed from the other. By diametrically opposed, it is meant that if a diameter were drawn across the body, one pair of walls would be located at one end of the diameter and the other pair of walls would be located at the other or opposite end of the diameter. The clamping means also comprises a threaded member 30 transverse to the axis of rotation 14 extending through the body and forming an included angle 32 of less than 90 degrees with the transverse seat 16.

It can be seen that, in FIGS. 2 through 4, the insert is firmly clamped between walls 26 and 28. To assist the clamping action, there is a saw cut 29 provided which gives a small amount of flexibility to the body 12. By virtue of this saw cut and the need to provide a passage for the vacuum, it can be seen in FIG. 6 that the seat 16 is actually comprised of four surfaces 3, 5, 7 and 9. All four of these surfaces cooperate to axially support the insert. When the threaded member 30 is rotated, the saw cut allows the body to flex and the insert is firmly but releasably clamped between oppositely facing walls 26 and 28.

It is preferable that, when the threaded member 30 forms an included angle 32 of less than 90 degrees with the transverse seat, this included angle of less than 90 degrees is rotationally rearward of the insert. In actual practice, this included angle of less than 90 degrees has been found to be most effective when it is about 45 degrees.

It is also preferable that the transverse threaded member 30 is located axially rearward of the insert. In this way, it is not necessary for the threaded member to pass through the insert which allows the insert to be stronger as well as easier to manufacture.

Figure 8:
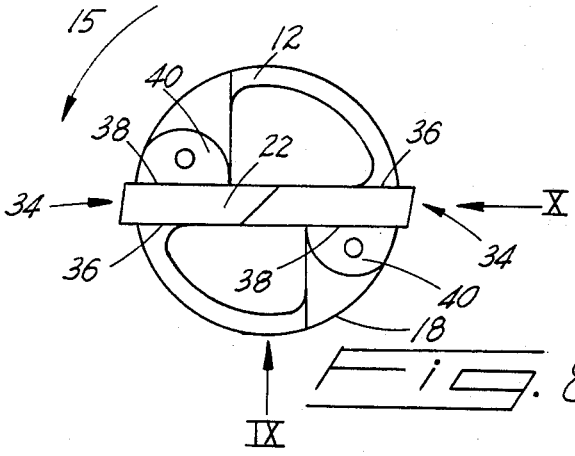
FIG. 8 is a plan view of another embodiment of the drill bit according to the invention.
Figure 9:
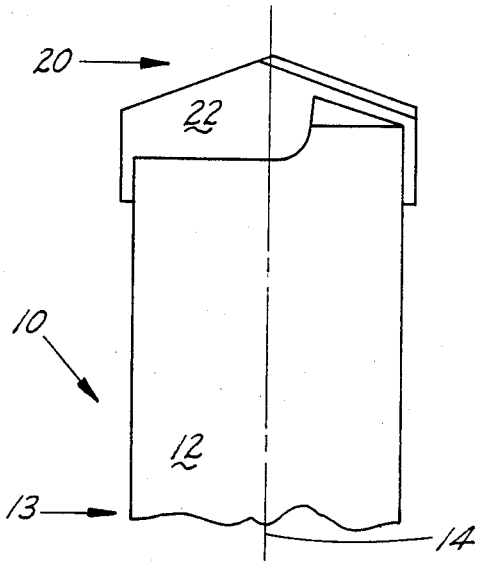
FIG. 9 is a view of FIG. 8 in the direction of arrow IX.
Figure 10:
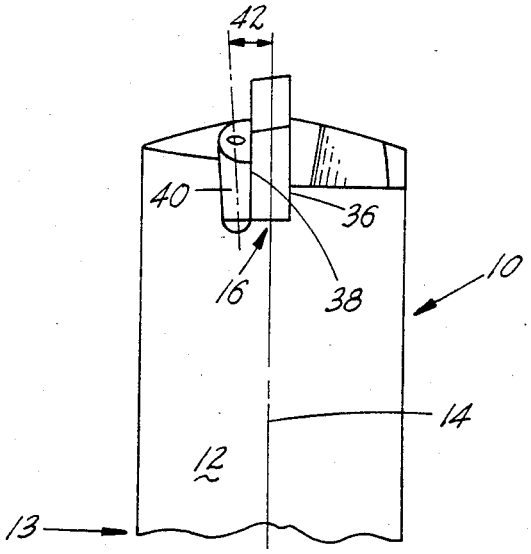
FIG. 10 is a view of FIG. 8 in the direction of arrow X.

In another embodiment of the drill bit according to the invention as shown in FIGS. 8 through 10, the clamping means comprises two pairs 34 of oppositely facing walls intersecting the periphery of the body. Each pair of walls is diametrically opposed from the other pair of walls. As explained above, by diametrically opposed, it is meant that each pair of walls is located at opposite ends of a diameter of the body. One wall 36 of each pair of walls extends axially forward from the seat 16 and the other wall 38 is a planar face of a wedge 40. The wedge 40 has a rotationally rearwardly tapering locking angle 42, which preferably is about seven degrees. As seen in FIG. 10, the wedges are located adjacent to the seat 16. It is preferable that the wedges 40 are located rotationally rearward of the insert 22.

If the insert were to be removed from the drill bit shown in FIGS. 8 through 10, the seat 16 would show the surfaces 3, 5, 7 and 9 which actually make up the seat, as was the case with the embodiment of FIGS. 2 through 7. However, since this embodiment does not require a saw cut for flexibility, surfaces 3 and 5 now form a single solid surface, as is the case also for surfaces 7 and 9.

Provisions are provided in the embodiments of FIGS. 2 through 7 and FIGS. 8 through 10 for means for centering the insert on the seat. The cooperating means for centering comprises a projection on one of the insert and body and a mating recess on the other of the insert and body. In one case, as shown in FIG. 5, the projection 44 extends axially rearwardly on the insert and the recess 46 is formed in the body 12. Once the insert is seated, as shown in FIG. 5, projection 44 engages recess 46 so as to constrain further diametrical movement of the insert. Thus, the insert becomes self-centered. Although the projection on the insert and the recess formed in the body is shown in the first embodiment of the invention in which a transverse threaded member is utilized, it is understood that the same configuration for centering the insert can similarly be used on the second embodiment of the invention where wedges are utilized instead of the transverse threaded member.

Figure 11:
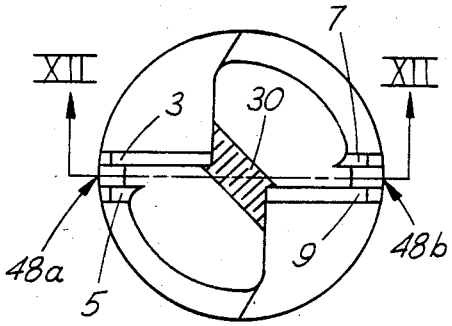
FIG. 11 is a plan view of another embodiment of the drill bit according to the invention with the insert removed.
Figure 12:
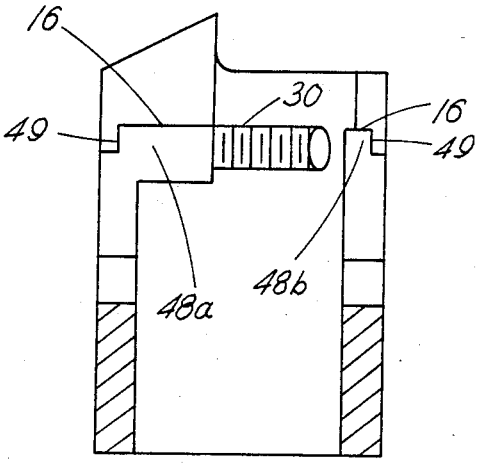
FIG. 12 is a sectional view of FIG. 11 in the direction of arrows XII—XII.

In another form of the centering means, as shown in FIGS. 11 through 15, the projection 48 extends axially forwardly within the body 12 with the seat 16 forming a part of the projection 48 and the recess 50 is formed in the insert 22. As in the other form of the centering means, projection 48 engages recess 50 so as to constrain further diametrical movement of the insert. In FIGS. 11 and 12, the embodiment with the transverse threaded member 30, it can be seen that the projection 48 is actually in two parts, **48*a* and 48*b*, and that the seat 16 forms the axially forward part of that projection. More specifically, surfaces 3 and 5 form the axially forward part of projection 48*a* while surfaces 7 and 9 form the axially forward part of projection 48*b*. It can also be seen in FIG. 12 that there are vertical portions 49** which also form a part of the projection.

Figure 13:
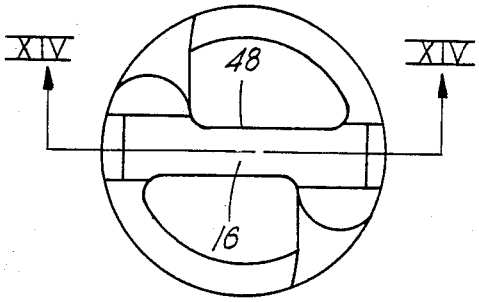
FIG. 13 is a plan view of another embodiment of the drill bit according to the invention with the insert removed.
Figure 14:
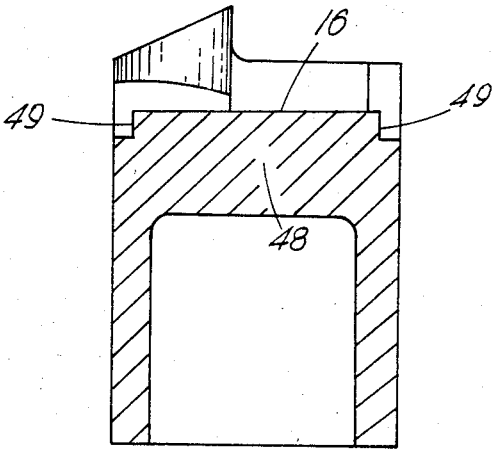
FIG. 14 is a sectional view of FIG. 13 in the direction of arrows XIV—XIV.

As illustrated in FIGS. 13 and 14, which shows the embodiment having the wedges, the projection 48 is solid across the body and the seat 16 forms the axially forward part of that projection. There are also vertical portions 49 which form a part of that projection.

Figure 15:
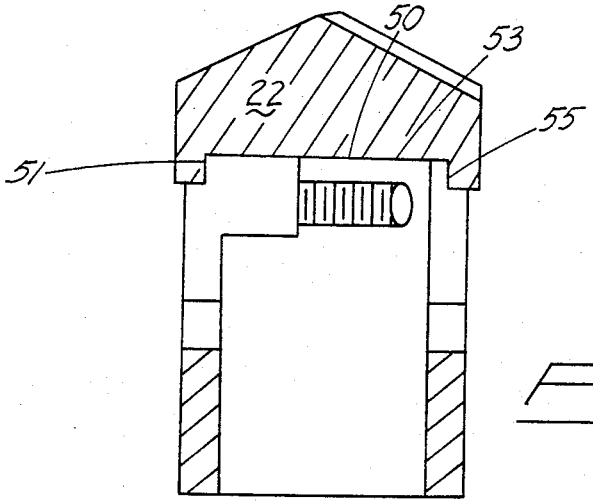
FIG. 15 is a sectional view similar to FIG. 12 but with the insert in place.
Figure 16:
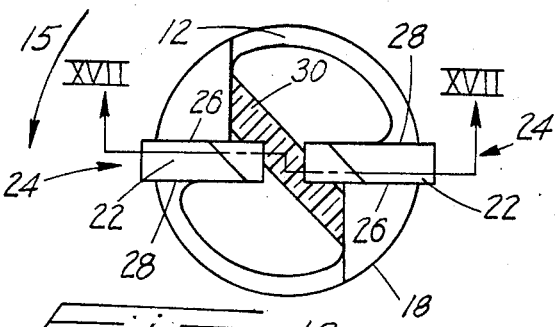
FIG. 16 is a plan view of another embodiment of the drill bit according to the invention.
Figure 18:
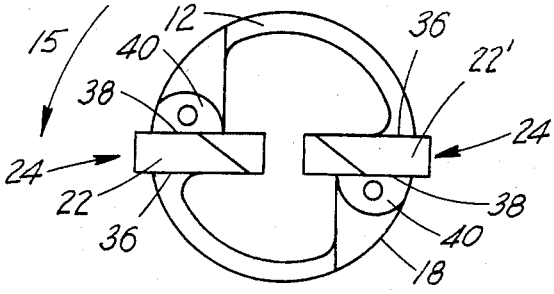
FIG. 18 is a plan view of another embodiment of the drill bit according to the invention.

As shown in FIG. 15, the insert 22 has a recess 50 which is generally bounded by sides 51, 53 and 55. While in FIG. 15 the insert is shown with the embodiment of the drill bit having the transverse threaded member of FIGS. 11 and 12, it is understood that this insert is similarly suitable for use with the drill body of FIGS. 13 and 14.

In other embodiments of the invention, as shown in FIGS. 16 through 19, the roof drill bit further comprises a second flat-like insert 22' positioned on the seat 16. Each of the inserts 22 and 22' are clamped by the each pair 24 of oppositely facing walls.

Figure 19:
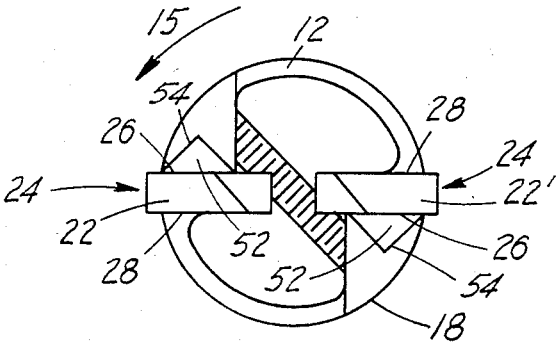
FIG. 19 is a plan view of another embodiment of the drill bit according to the invention.

In those embodiments of the drill bit having two inserts, it is also contemplated that provisions may be provided for cooperating means for locating each of the inserts on the seat. In FIG. 19, it is shown that the cooperating means for locating comprises a V-shaped projection 52 on a rotationally rearward face of each of the inserts 22 and 22' and a mating V-shaped recess 54 on the rotationally forward facing wall 26 of the pair 26, 28 of oppositely facing walls.

Figure 17:
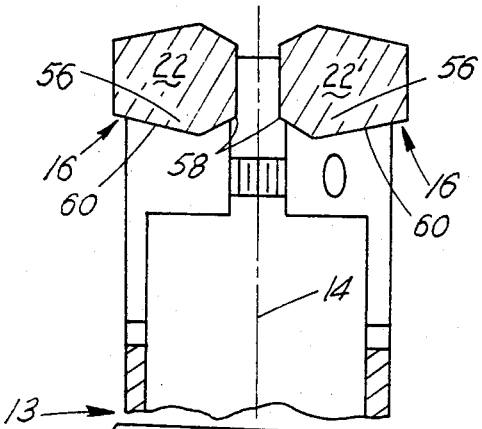
FIG. 17 is a sectional view of FIG. 16 in the direction of arrows XVII—XVII.

Another form of the cooperating means for locating the insert is shown in FIG. 17. In this figure, the cooperating means comprises a V-shaped projection 56 on an axially rearward face 58 of each of the inserts 22 and 22' and a mating V-shaped recess 60 on the seat 16.

The embodiments of the drill bit having two inserts can have the inserts clamped by a threaded member (FIG. 16) or by use of wedges (FIG. 18) or there may be means provided on either of these embodiments for locating the insert on the drill body (FIGS. 17 and 19).

Figure 20:
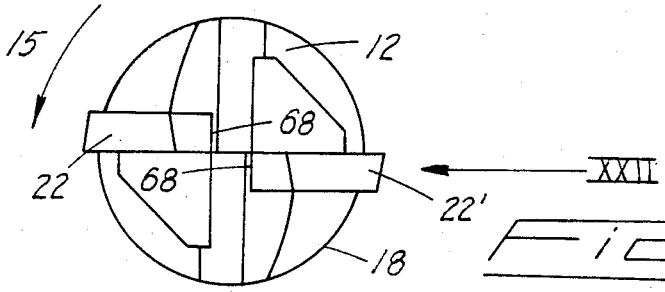
FIG. 20 is a plan view of still another embodiment of the drill bit according to the invention.
Figure 21:
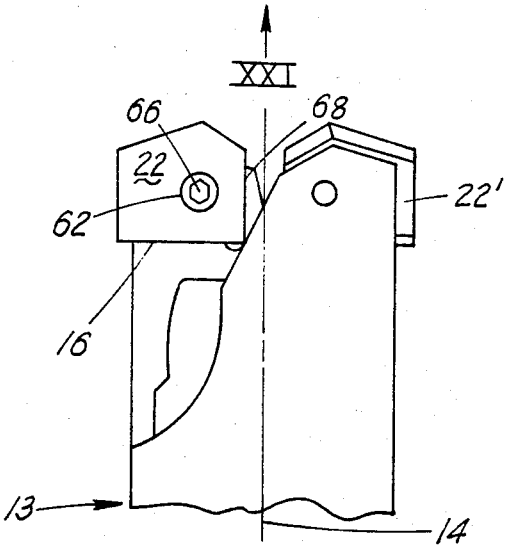
FIG. 21 is a view of FIG. 20 in the direction of arrow XXI.
Figure 22:
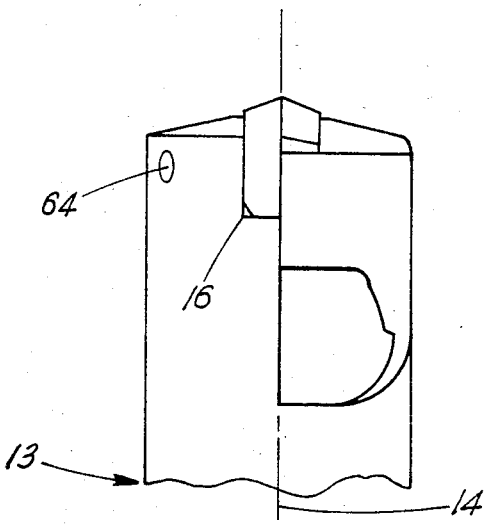
FIG. 22 is a view of FIG. 20 in the direction of arrow XXII.

In a final embodiment of the roof drill bit, as shown in FIGS. 20 through 22, the drill bit comprises a second flat-like insert 22' positioned on the seat 16. Each of the inserts has a perforation 62. The body 12 has a number of threaded recesses 64 equal to the number of perforations such that, when each of the inserts is positioned on the seat 16, each perforation 62 will register with a threaded recess 64. The means for clamping comprises a threaded member 66 extending through the perforation 62 of each insert and engaging the respective threaded recess 64.

As best seen in FIGS. 21 and 22, each insert sits on a single surface, which is seat 16. As an aid in locating the insert, there are walls 68 provided. The combination of seat 16 and wall 68 acts as a pocket for holding and locating the insert.

Modifications may be made within the scope of the appended claims.

What is claimed is:

1. A center vacuum roof drill bit comprising: a body having an axis of rotation, a seat transverse to said axis of rotation, a periphery and a forward working end; at least one flat-like insert positioned on said seat; means for releasably clamping said insert; said means clamping said insert near the periphery of said body and said clamping means comprising two pairs of oppositely facing walls intersecting said periphery, each pair of walls being diametrically opposed from the other, one wall of said each pair of walls extending axially forward from said seat and the other wall being a planar face of a wedge having a rearwardly tapering locking angle, said wedges being adjacent to said seat.

2. The center vacuum roof drill bit of claim 1 wherein said clamping means comprises two pairs of oppositely facing walls extending axially forward from said seat and intersecting said periphery, each pair of walls being diametrically opposed from the other; and a threaded member transverse to said axis of rotation extending through said body and forming an included angle of less than 90 degrees with said transverse seat.

3. The center vacuum roof drill bit of claim 2 wherein said included angle of less than 90 degrees is rotationally rearward of said insert.

4. The center vacuum roof drill bit of claim 3 wherein said transverse threaded member is axially rearward of said insert.

5. The center vacuum roof drill bit of claim 1 wherein said wedges are rotationally rearward of said insert.

6. The center vacuum roof drill bit of claims 4 or 5 further comprising cooperating means for centering said insert on said seat.

7. The center vacuum roof drill bit of claim 6 wherein said cooperating means for centering comprises a projection on one of said insert and body and a mating recess on the other of said insert and body.

8. The center vacuum roof drill bit of claim 7 wherein said projection extends axially rearwardly on said insert and said recess is formed in said body.

9. The center vacuum roof drill bit of claim 8 wherein said projection extends axially forwardly with said seat forming a part of said projection and said recess is formed in said insert.

10. The center vacuum roof drill bit of claims 4 or 6 further comprising a second flat-like insert positioned on said seat, each of said inserts being clamped by said each pair of oppositely facing walls.

11. The center vacuum roof drill bit of claim 10 further comprising cooperating means for locating each of said inserts on said seat.

12. The center vacuum roof drill bit of claim 11 wherein said cooperating means for locating comprises a V-shaped projection on a rotationally rearward face of each of said inserts and a mating V-shaped recess on the rotationally forwardly facing wall of said pair of oppositely facing walls.

13. The center vacuum roof drill bit of claim 11 wherein said cooperating means for locating comprises a V-shaped projection on an axially rearward face of each of said inserts and a mating V-shaped recess on said seat.

14. The center vacuum roof drill bit of claim 1 further comprising a second flat-like insert positioned on said seat, each of said inserts having a perforation; said body having a number of threaded recesses equal to the number of perforations such that when each of said inserts is positioned on said seat, each perforation will register with a threaded recess; wherein said means for clamping comprises a threaded member extending through the perforation of each insert and engaging the respective threaded recess.

* * * * *